United States Patent [19]

Raphal et al.

[11] Patent Number: 4,693,531

[45] Date of Patent: Sep. 15, 1987

[54] CONNECTING DEVICE FOR TESTING PRINTED CIRCUIT

[76] Inventors: Francis Raphal; Jean-Paul Roy, both of 41, rue Cantagrel, 75624 Paris 13, France

[21] Appl. No.: 660,276

[22] Filed: Oct. 12, 1984

[30] Foreign Application Priority Data

Oct. 14, 1983 [FR] France ..... 83 16366

[51] Int. Cl.[4] ..... H01R 31/08

[52] U.S. Cl. ..... 439/512; 439/680; 439/514

[58] Field of Search ..... 339/176 M, 17 R, 17 L, 339/17 LC, 206 R, 206 P, 186 R, 186 M, 184 R, 184 M, 91 R, 176 MP, 17 C, 151 B, 150 B, 19, 222, 110 P

[56] References Cited

U.S. PATENT DOCUMENTS

| | | | |
|---|---|---|---|
| 3,016,512 | 1/1962 | Borchard | 339/176 M |
| 3,137,535 | 6/1964 | Collier et al. | 339/186 M |
| 3,697,927 | 10/1972 | Kunkle et al. | 339/19 |
| 3,771,102 | 11/1973 | Murray et al. | 339/19 |
| 4,034,284 | 7/1977 | Peplow et al. | 339/110 P |
| 4,398,073 | 8/1983 | Botz et al. | 339/91 R |
| 4,420,209 | 12/1983 | Reis et al. | 339/91 R |
| 4,431,244 | 2/1985 | Anhalt et al. | 339/91 R |
| 4,460,235 | 7/1985 | Gelin | 339/176 MP |

*Primary Examiner*—Eugene F. Desmond
*Assistant Examiner*—Thomas M. Kline
*Attorney, Agent, or Firm*—Laubscher & Laubscher

[57] ABSTRACT

A connecting device for printed circuit comprises a base member with male contacts, an intermediate member with female contacts and a plug with female contacts. The female contacts of the intermediate member extend right through the intermediate member and are shorter in length than the base member male contacts. The base member male contacts are pluggable into the female contacts of the plug after the intermediate member has been engaged in the base member, the male contacts of which run right through the female contacts of the intermediate member.

9 Claims, 4 Drawing Figures

CONNECTING DEVICE FOR TESTING PRINTED CIRCUIT

BACKGROUND OF THE INVENTION

1. Field of the Invention

The present invention relates to a connecting device for testing printed circuits, comprising a base member having at least two parallel male contacts, an intermediate member having at least two parallel female contacts and a plug having at least two parallel female contacts. The base member male contacts are pluggable completely through the intermediate member female contacts for insertion in the plug female contacts.

2. Description of the Prior Art

Such a connecting device is used for testing printed circuit boards and in particular for detecting defects in the electrical continuity of printed conductors on the boards.

In a known device of this type, the intermediate member is a parallelepipedal block carrying blind female contacts, with the length of the intermediate member female contacts being equal to that of the base member male contacts. The two female contacts of the intermediate member are electrically interconnected by a short-circuit contained in the intermediate member, thereby to short circuit two conductors printed on the board to which the remote ends of the male contacts are connected.

Furthermore, the plug referred to as test plug is a parallelepipedal module greater in length than the intermediate member. The female contacts of the plug receive the base member male contacts once the intermediate member is removed from the base member. The test plug is therefore not intended for testing the link between the two printed conductors. The test plug is used to solely test each of the printed conductors individually.

Further, especially when the base member, the intermediate member and the plug each carry two parallel and juxtaposed contact pairs, the intermediate member or the plug turned around through 180° about the direction of the contacts can again be plugged into the base member. An 180° reversion such as this generates error in the measurements and can be avoided only through special care on the part of an user when making the connections.

OBJECT OF THE INVENTION

The main object of the present invention is to provide a connecting device for printed circuits that makes it possible to electrically connect the female contacts of the plug to the female contacts of the intermediate member when the latter is plugged into the base member in order to test printed conductors connected in pairs across the intermediate member.

SUMMARY OF THE INVENTION

Accordingly, in a connecting device embodying the invention, the female contacts of the intermediate member extend completely through the intermediate member and are shorter in length than the male contacts of the base member. The male contacts of the base member are pluggable in the plug female contacs, since after plugging the intermediate member into the base member, the male contacts of the base member extend completely through the female contacts of the interediate member.

As a result of the foregoing feature, the base member, the intermediate member and the plug are stacked parallel to the contacts, whereby two female contacts in the plug can be connected to two printed conductors short-circuited across the intermediate member.

According to a further feature of the invention, first and second locking means are provided for locking the intermediate member to the base member and to the test plug, respectively.

DESCRIPTION OF THE DRAWING

The foregoing and other objects, features and advantages of the invention will be apparent from the following detailed description of several preferred embodiments of the invention with reference to the corresponding accompanying drawings in which.

DESCRIPTION OF THE PREFERRED EMBODIMENTS

Figure 1:
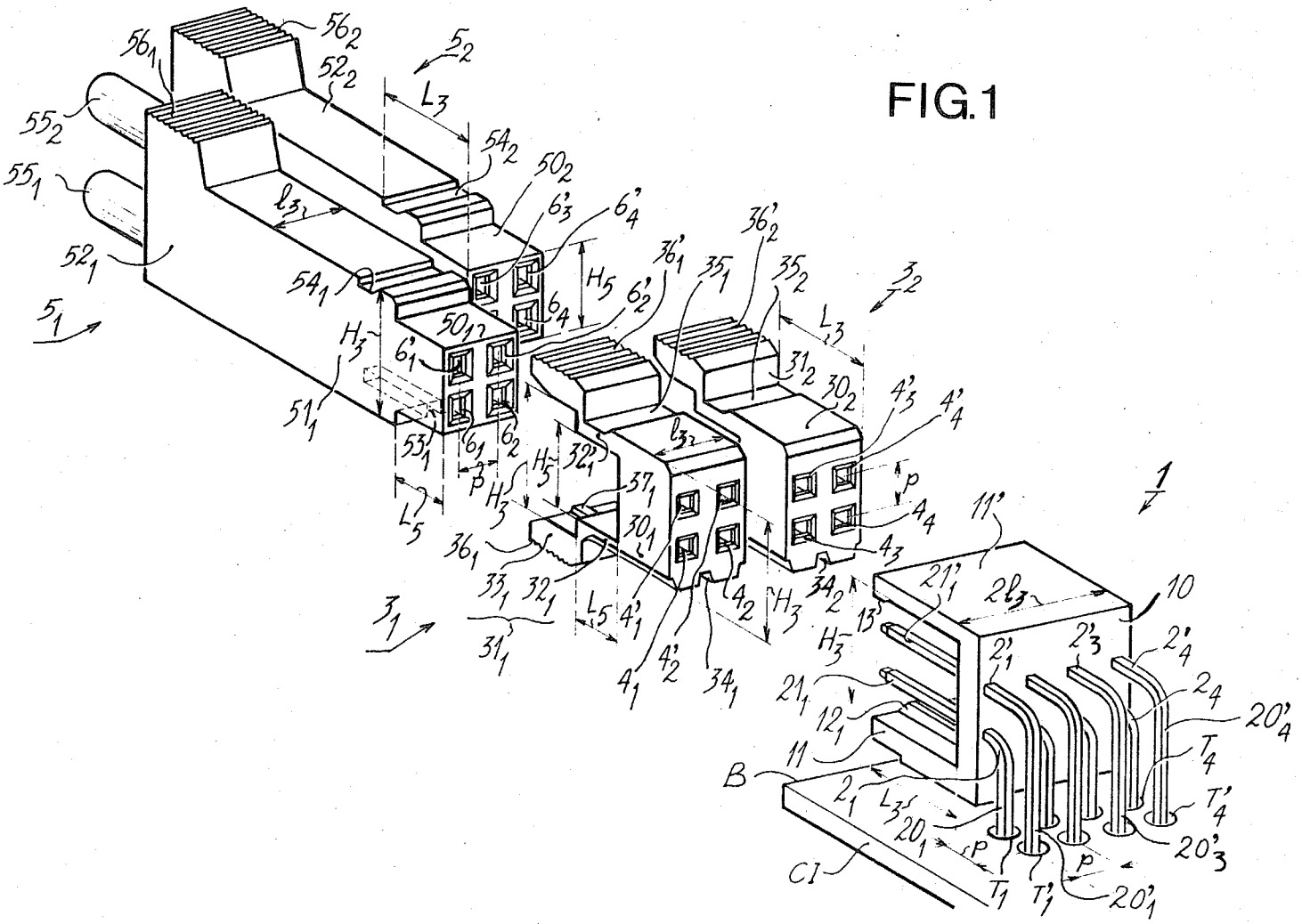
FIG. 1 is an exploded view in perspective of a connecting device of the invention, comprising a base member with four pairs of male contacts intended for receiving two intermediate members and two plugs each with two pairs of female contacts.

A connecting device illustrated in FIG. 1 is related to four pairs of conductors printed on a printed circuit board CI under test. A metallized hole T is associated with each printed conductor. As depicted in FIG. 1, first holes $T_1$ to $T_4$ respectively associated with the conductor pairs are aligned along one edge B of the printed circuit board cross-ways on to the connecting device, and second holes $T_1'$ to $T_4'$ respectively associated with the conductor pairs are aligned parallel to the row of first holes and are respectively aligned two-by-two with the first holes, perpendicularly to the edge B. The holes are typically spaced out at a pitch p=2.54 mm.

The connecting device according the illustrated embodiment comprises a female base 1 with four pairs of male electrical contacts $\mathbf{21_1}$—$\mathbf{21_1'}$ to $\mathbf{21_4}$—$\mathbf{21_4'}$, two male-female intermediate members $\mathbf{3_1}$, $\mathbf{3_2}$ each carrying two pairs of female electrical contacts $\mathbf{4_1}$—$\mathbf{4_1'}$ and $\mathbf{4_2}$—$\mathbf{4_2'}$, $\mathbf{4_3}$—$\mathbf{4_3'}$ and $\mathbf{4_4}$—$\mathbf{4_4'}$, and two test plugs $\mathbf{5_1}$, $\mathbf{5_2}$ each carrying two pairs of female electrical contacts $\mathbf{6_1}$—$\mathbf{6_1'}$ and $\mathbf{6_2}$—$\mathbf{6_2'}$, $\mathbf{6_3}$—$\mathbf{6_3'}$ and $\mathbf{6_4}$—$\mathbf{6_4'}$. Members 1, $\mathbf{3_1}$, $\mathbf{3_2}$, $\mathbf{5_1}$ and $\mathbf{5_2}$ are made of insulating material such as plastic.

The base member 1 has a U-shaped longitudinal cross-section with a square cross-sectioned vertically-arranged front portion 10 and suare cross-sectioned horizontally arranged parallel vertically-spaced leg portions or branches 11 and 11'. The base member includes four pairs of parallel conducting pins $\mathbf{2_1}$—$\mathbf{2_1'}$ to $\mathbf{2_4}$—$\mathbf{2_4'}$ that are mutually arranged in an identical fashion to holes $T_1$—$T_1'$ to $T_4$—$T_4'$ on the printed circut board CI. Each pin $\mathbf{2_1}$ to $\mathbf{2_4}$, $\mathbf{2_1'}$ to $\mathbf{2_4'}$ perpendicularly runs through and is fixed to the front portion or plate 10 of the base member. The plate 10 divides each pin $\mathbf{2_1}$ to $2_4$, $2_1'$ to $2_4'$ into a first portion with a right-angle elbow $20_1$ to $20_4$, $20_1'$ to $20_4'$ extending toward the lower leg portion 11 of the base member, and a second rectilinear portion forming the male contact $21_1$ to $21_4$, $21_1'$ and $21_4'$ between the leg portions 11 and 11'.

The tips of the first right-angled portions $20_1$ to $20_4$ and $20_1'$ to $20_4'$ form points that run through the metallized holes $T_1$ to $T_4$,$T_1'$ to $T_4'$ and that are respectively soldered thereto, preferably using tin wave, once the lower leg portion 11 of the base member has been pressed against the printed circuit board between the edge B and the row of holes $T_1$ to $T_4$.

In another embodiment, the first portions of the pins $2_1$ to $2_4$, $2_1'$ to $2_4'$ are straight and perpendicular to the plate 10 of the base member 1; in this case, intermediate members $3_1$, $3_2$ and the plugs $5_1$, $5_2$ engage perpendicularly into the printed circuit board CI.

The male contacts $21_1$ to $21_4$ and $21_1'$ to $21_4'$ are arranged parallel to the leg portions 11 and 11' and have a length substantially equal to length $L_3$ of the leg portions 11 and 11'. The first row of first contacts $21_1$ to $21_4$ lies above the lower leg portion 11 and at a distance therefrom equal to the distance between the second row of first contacts $21_1'$ to $21_4'$ and the upper leg portion 11'.

Between the first two pairs of male contacts $21_1$—$21_1'$ and $21_2$—$21_2'$ and between the last two pairs of male contacts $21_3$—$21_3'$ and $21_4$—$21_4'$, the inner surface of the lower leg portion 11 of the base member carries two keys $12_1$ and $12_2$ parallel to the male contacts. Along the transverse edge of the upper leg portion 11' of the base member, the inner surface of the leg portion 11' carries a transverse key 13 perpendicular to the male contacts.

Each intermediate member $3_1$, $3_2$ has a U-shaped longitudinal cross-section and consists of a front parallelepipedal block $30_1$, $30_2$ and two rear arms $31_1$ and $31_1'$, $31_2$ and $31_2'$. Each intermediate member block $30_1$, $30_2$ contains two pairs of female contacts $4_1$—$4_1'$ and $4_2$—$4_2'$, $4_3$—$4_3'$ and $4_4$—$4_4'$ that are designed to receive the pairs of male contacts $21_1$—$21_1'$ and $21_2$—$21_2'$, $21_3$—$21_3'$ and $21_4$—$21_4'$, respectively, when the intermediate member and base member are assembled. Each female contact of an intermediate member is formed of a sleeve consisting of metal strips longitudinally extending through the intermediate member block.

The block $30_1$, $30_2$ with first portions $32_1$ and $32_1'$, $32_2$ and $32_2'$ of the arms $31_1$ and $31_1'$, $31_2$ and $31_2'$ of the intermediate member forms a male portion having longitudinal and transverse outer profiles complementary to the longitudinal and transverse inner profiles of one half of the base member 1 housing two contacts pairs $21_1$—$21_1'$ and $21_2$—$21_2'$, $21_3'$—$21_3'$ and $21_4$—$21_4'$. A longitudinal central blind groove $34_1$, $34_2$ entends in the lower surface of each intermediate member $3_1$, $3_2$ to receive the respective key $12_1$, $12_2$ on the base member, and at the upper side of the first branch portion $32_1'$, $32_2'$ a transverse groove $35_1$, $35_2$ is included to receive one half of the transverse key 13 of the base member. The length $L_3$, width $l_3$ and height $H_3$ of the male portion $30_1$-$32_1$-$32_1'$, $30_2$-$32_2$-$32_2'$ of each intermediate member are respectively equal to the length and the half-width of the flat leg portions 11 and 11' of the base member and the spacing between the flat leg portions 11 and 11'. Since the length of the male contacts $21_1$ to $21_4$ and $21_1'$ to $21_4'$ is substantially equal to the length $L_3$ of the flats 11 and 11', tip portions of the male contacts protrude from the rear surface of the blocks $30_1$ and $30_2$ to a length equalling that of the first arm portions $32_1$, $32_1'$, $32_2$, $32_2'$ when the intermediaire member blocks are plugged in and pushed against the inner surface of the plate 10 on the base member 1.

Figure 2:
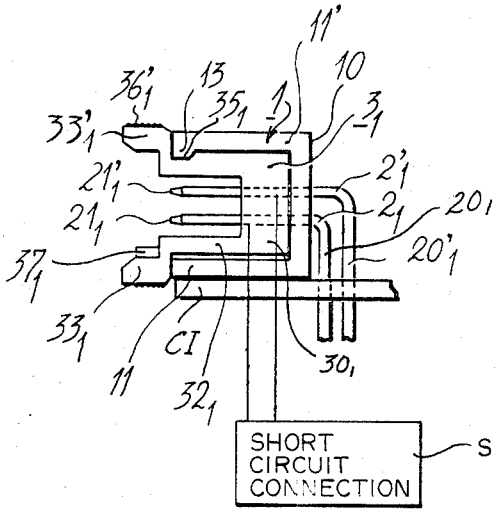
FIG. 2 is a longitudinal side view of the intermediate member/base member assembly.

At this first stage of assembly, as depicted in FIG. 2, the intermediate members $3_1$ and $3_2$ are preferably of the type carrying short-circuits to connect respectively two-by-two the sleeves $4_1$ and $4_1'$ to $4_4$ and $4_4'$ of the pairs and thus the printed conductors associated with the holes $T_1$ and $T_1'$ to $T_4$ and $T_4'$. Should only two sleeves inserts such as $4_1$ and $4_1'$ in the intermediate member $3_1$ be electrically connected, then the groove $34_1$ and the key $12_1$ assembly serves especially as polarizing or fool-proof means such that the intermediate member cannot be turned through 180° for plugging into the base member, thereby avoiding any unwanted connection of the other two male contacts $21_2$ and $21_2'$.

The assembly of the groove $35_1$, $35_2$ of each intermediate member with the transverse key 13 of the base member serves as polarizing or fool-proof means and also as locking means in longitudinal translation of the intermediate members in the base member once the upper resilient flat branch 11' of the base member has clipped in place after insertion of the intermediate member block $30_1$, $30_2$.

Each of the arms $31_1$, $31_1'$, $31_2$, $31_2'$ of the intermediate members consists of the first portion $32_1$, $32_1'$, $32_2$, $32_2'$ already mentioned and a second end portion $33_1$, $33_1'$, $33_2$, $33_2'$ protruding outwardly. The distance between the second arm portions of each intermediate member is equal to the spacing $H_3$ between the flats 11 and 11' of the base member 1. Outer surfaces $36_1$, $36_1'$, $36_2$, $36_2'$ of the second arm portions of the intermediate members are transversally ribbed to make it easier to grip the intermediate members. On the inner surface of the lower second arm portion $31_1$, $31_2$ of each member $3_1$, $3_2$, a central longitudinal key $37_1$, $37_2$ is provided and has a transverse cross-section identical to that of transverse keys $12_1$ and $12_2$ on the lower flat branch 11 of the base member 1.

With reference again to FIG. 1, each test plug $5_1$, $5_2$ is parallelepipedal in overall shape and comprises a front parallelepipedal block $50_1$, $50_2$, a male intermediate portion $51_1$, $51_2$ and a elongated rear portion $52_1$, $52_2$.

Figure 3:
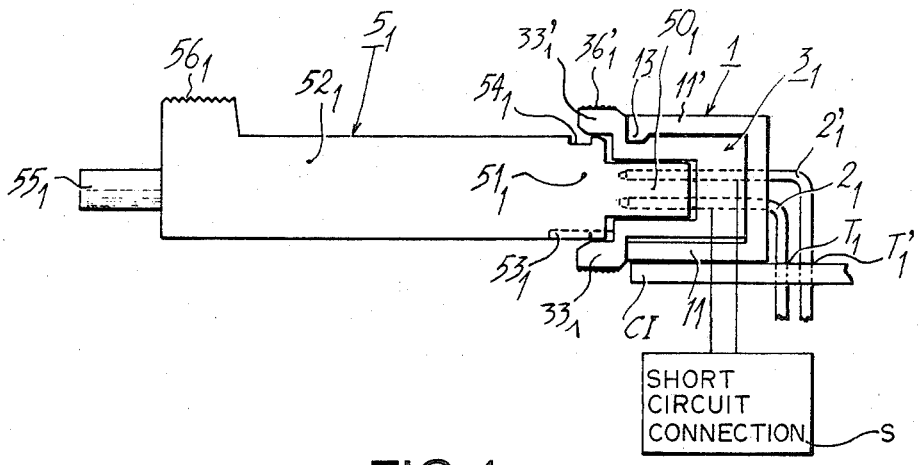
FIG. 3 is a longitudinal side view of the intermediate member/base member assembly as well as the assembly of the plug with the intermediate member in the base member.

Each block $50_1$, $50_2$ carries dimensions identical to the parallelepipedal space lying between the arm portions $32_1$ and $32_1'$, $32_2$ and $32_2'$ of each member $3_1$, $3_2$. Consequently, the length $L_5$ of the blocks $50_1$, $50_2$ is equal to the length of the first arm portions $32_1$ and $32_1'$, $32_2$ and $32_2'$ of the intermediate members, and the height $H_5$ of the blocks $50_1$, $50_2$ is equal to the spacing between the intermediate member arm portions $32_1$ and $32_1'$, $32_2$ and $32_2'$ and is smaller than the spacing $H_3$, between the flat branches 11 and 11' of the base member 1. Each block $50_1$, $50_2$ contains two pairs of parallel conducting sleeves $6_1$—$6_1'$ and $6_2$—$6_2'$, $6_3$—$6_3'$ and $6_4$—$6_4'$, forming female contacts that are transversally arranged in an identical fashion to the sleeves in each intermediate member. As shown in FIG. 3, when an intermediate member, such as member $3_1$, is plugged into the base member 1 against the plate 10, the full insertion of the block $50_1$ of the associated plug $5_1$ between the first arm portions $32_1$ and $32_1'$ is such tha the assemblage of the block $30_1$ of intermediate member $3_1$ and the block $50_1$ of plug $5_1$ is completely contained in the base member 1 where the length of the intermediate member block $30_1$ is equal to ($L_3$-$L_5$). The pairs of male contacts $21_1$—$21_1'$ and $21_2$—$21_2'$ fully slide through the pairs of sleeves $4_1$—$4_1'$ and $4_2$—$4_2'$ in the member $3_1$ and penetrate into the sleeve pairs $6_1$—$6_1'$ and $6_2$—$6_2'$ of plug $5_1$ respectively, over a length substantially equal to $L_5$.

Figure 4:
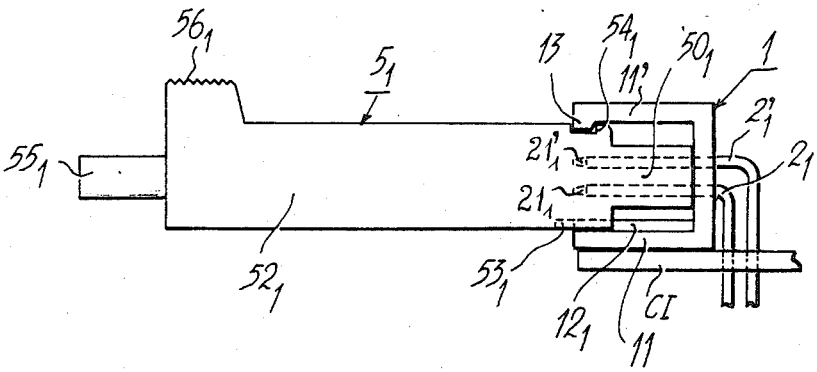
FIG. 4 is a longitudinal side view of the assembly of the plug directly with the base member.

The mechanical assembly of the intermediate member $3_1$, $3_2$ with the corresponding plug $5_1$, $5_2$ is obtained in a manner analogous to the mechanical assembly of the intermediate member $3_1$, $3_2$ with the base member 1 such that the plug $5_1$, $5_2$ may also be directly engaged in the base member 1 as shown in FIG. 4. For this purpose, the intermediate male portion $51_1$, $51_2$ of each plug $5_1$, $5_2$ carries longitudinal and transversal profiles analogous to the longitudinal and transversal profiles of the space between the second arm portions $33_1$ and $33_1'$, $33_2$ and $33_2'$ of each intermediate member and analogous to the longitudinal and transversal profiles of the space between the flat leg portions 11 and 11' of the base member over a length ($L_3$–$L_5$) taken from the edges of the leg portions 11 and 11'. Each intermediate portion of plug $51_1$, $51_2$ is equal in height to $H_3$. In the lower surface of each plug portion $51_1$, $51_2$, a longitudinal central blind groove $53_1$, $53_2$ runs as shown in dotted lines in FIG. 1, in order to receive the intermediate member key $37_1$, $37_2$ or a key $12_1$, $12_2$ of base member 1. In the upper surface of each plug portion $51_1$, $51_2$, a transverse groove $54_1$, $54_2$ is included to receive one half of the rear transverse key 13 of the base member or, where applicable, a transverse key (not shown) beneath the inner surface of a second portion of upper intermediate member arm $33_1'$, $33_2'$ in another embodiment of the intermediate member.

The rear portion $52_1$, $52_2$ of each plug $5_1$, $5_2$ contains four sheathed conductive wires respectively connected to the four female contacts $6_1$, $6_1'$, $6_2$ and $6_2'$, $6_3$, $6_3'$, $6_4$ and $6_4'$ that leave the plug through a tubular sleeve $55_1$, $55_2$ extending rearwardly from the plug. The insulated conductive wires are intended to be connected to printed circuit board monitor and test apparatus. The rear of the upper face of each plug $5_1$, $5_2$ offers a shoulder $56_1$, $56_2$, the upper surface of which is transversally ribbed in order to ease gripping of the plug.

In operation, assumes that intermediate member $3_1$ contains a first short circuit (S in FIG. 3) between female contacts $4_1$ and $4_1'$, and a second short circuit (not shown) between female contacts $4_2$ and $4_2'$. Consequently, when the components are assembled as shown in FIG. 3, a first short circuit is established between the printed circuit conductors associated with holes $T_1$ and $T_1'$, and a second short circuit is established between the printed circuit conductors associated with holes $T_2$ and $T_2'$.

The direct assembly of plug, such as plug $5_1$, and the base member 1 as shown in FIG. 4 makes it possible to test individually the printed conductors associated with the holes $T_1$, $T_1'$, $T_2$ and $T_2'$, and in particular to detect any breaks in the printed conductors.

Several base members, such as base member 1, can be juxtaposed along the edge B of the printed circuit board CI to form a connecting strip.

In other embodiments, a base member can include more than four pairs of male contacts and accommodate more than two corresponding intermediate members and/or plugs. An intermediate member can include more than two pairs of female contacts. Generally speaking, a base member, an intermediate member and a plug embodying the invention each comprise at least two contacts, such as the two male contacts $2_1$ and $2_1'$, two female contacts $4_1$ and $4_1'$ and two female contacts $6_1$ and $6_1'$, respectively.

In other embodiments, the mechanical fool-proof means between the three members 1, $3_1$ and $5_1$ of a connecting device embodying the invention are reciprocal assemblies of those described above. Consequently, a longitudinal key $12_1$ on the base member 1 is replaced by a longitudinal groove to receive a longitudinal key replacing the groove $34_1$ in the intermediate member $3_1$, or replacing the groove $53_1$ in the plug $5_1$; the transverse key 13 on the base member 1 is replaced by a transverse groove to receive a longitudinal key replacing the groove $35_1$ in the intermediate member $3_1$ or replacing the groove $54_1$ in the plug $5_1$.

What we claim is:

1. Apparatus for electrically testing a printed circuit board (CI), comprising (a) a generally U-shaped base member (1) having a transverse portion (10) and a pair of parallel spaced leg portions (11, 11');

(b) at least one intermediate member ($3_1$, $3_2$) removably mounted within the space defined between said leg portions, said intermediate member comprising a generally U-shaped block having a transverse portion ($30_1$, $30_2$) and a pair of parallel spaced leg portions ($32_1$, $32_1'$), said intermediate member being arranged with the same orientation as said base member and with its transverse portion adjacent the transverse portion of said base member;

(c) at lease one plug member ($5_1$, $5_2$) arranged on the opposite side of said intermediate member from said base member;

(d) the transverse portion of said intermediate member containing a plurality of parallel through openings extending longitudinally in the direction between said base and plug members;

(e) a plurality of open-ended first female contacts ($4_1$, $4_1'$) mounted in the through openings contained in said intermediate member, respectively, said plug member having at one end an end portion extending within the space defined between said intermediate member leg portions, said one end portion containing a plurality of second female contacts ($6_1$, $6_1'$) arranged colinearly opposite said first female contacts, respectively;

(f) a plurality of parallel male contacts ($21_1$, $21_1'$) mounted on said base member, said male contacts extending at one end completely through said first female contacts and into the corresponding second female contacts, respectively, said male contacts being adapted for connection at their other ends with conductors on the printed circuit board; and (g) short circuit means (S) contained in said intermediate member for establishing a short circuit between at least one pair of said first female contacts, thereby to short circuit the associated pair of male contacts and the printed circuit conductors associated therewith, said second female contacts being operable to directly receive said male contacts upon removal of said intermediate member from said base member and upon insertion of said plug member one end within the space defined between said base member leg portions.

2. Apparatus as defined in claim 1, wherein said first and second female contacts of said intermediate member and said plug member, respectively, consist of metal sleeves.

3. Apparatus as defined in claim 1, wherein said intermediate member and said plug member include ribbed portions ($36_1$, $36_2'$; $56_1$ $56_2$) protruding from said intermediate member and said plug member, respectively, thereby to provide an easier grip on said intermediate member and said plug member.

4. Apparatus as defined in claim 1, and further including first polarizing means ($12_1$, $12_2$) included in said base member, second polarizing means ($34_1$, $34_2$) included in said intermediate member for cooperating with said first polarizing means when said intermediate member is plugged into said base member, and third polarizing means ($53_1$, $53_2$) included in said plug member for cooperating with said first polarizing means when said plug member is directly plugged into said base member in the absence of said intermediate member.

5. Apparatus as defined in claim 4, and further including fourth polarizing means ($37_1$, $37_2$) included in said intermediate member for cooperating with said third polarizing means when said plug member is plugged into said intermediate member.

6. Apparatus as defined in claim 4, wherein said first polarizing means is a key ($12_1$, $12_2$) parallel to said male contacts of said base member, wherein said second polarizing means is a groove ($34_1$, $34_2$) parallel to said first female contacts in said intermediate member, and wherein said third polarizing means is a groove ($53_1$, $53_2$ parallel to said second female contacts in said plug member.

7. Apparatus as defined in claim 5, wherein said fourth polarizing means includes a key ($37_1$, $37_2$) parallel to said first female contacts and cooperating with said third polarizing means when said intermediate and plug members are plugged together.

8. Apparatus as defined in claim 1, and further including first locking means (13) included in said base member, second locking means ($35_1$, $35_2$) included in said intermediate member for cooperating with said first locking means to lock said intermediate member in said base member transversely to the direction of insertion thereof, and third locking means ($54_1$, $54_2$) included in said plug member for cooperating with said first locking means in the absence of said intermediate member, thereby locking said plug in said base member transversely to the plugging direction thereof.

9. Apparatus as defined in claim 8, wherein said first locking means (13) is a key substantially perpendicular to said male contacts of said base member, said second locking means is a groove ($35_1$, $35_2$) substantially perpendicular to said first female contacts in said intermediate member, and said third locking means is a groove ($54_1$, $54_2$) substantially perpendicular to said second female contacts in said plug member.

* * * * *